United States Patent [19]

Koppensteiner

[11] Patent Number: 4,556,155

[45] Date of Patent: Dec. 3, 1985

[54] ELEVATOR GOVERNOR

[75] Inventor: Werner Koppensteiner, Vienna, Austria

[73] Assignee: Otis Elevator Company, Farmington, Conn.

[21] Appl. No.: 542,304

[22] Filed: Oct. 14, 1983

[30] Foreign Application Priority Data

Apr. 13, 1983 [AT] Austria ..... 1321/83

[51] Int. Cl.[4] ..... B66B 5/04

[52] U.S. Cl. ..... 187/38; 187/89; 188/184; 254/267

[58] Field of Search ..... 187/38, 89, 88; 188/184, 185, 186; 254/267; 192/105 CE; 49/322; 73/535; 74/3

[56] References Cited

U.S. PATENT DOCUMENTS

| | | | |
|---|---|---|---|
| 947,150 | 1/1910 | Downey et al. | 188/184 |
| 1,101,726 | 6/1914 | Catucci | 188/186 |
| 3,273,671 | 9/1966 | Vrana | 187/88 |
| 3,327,811 | 6/1967 | Mastroberte | 187/38 |
| 3,762,512 | 10/1973 | McIntyre | 187/88 |
| 4,029,177 | 6/1977 | Fiss | 187/89 |
| 4,333,549 | 6/1982 | Davis | 187/88 |

*Primary Examiner*—Joseph J. Rolla
*Assistant Examiner*—Nils E. Pedersen
*Attorney, Agent, or Firm*—Robert E. Greenstien

[57] ABSTRACT

A flywheel or disc rotates around a circular stationary surface, for example, a shaft, the disc is configured relative to the stationary surface so as to define the tapered area or gap at diametrically opposite positions. Two flyweights that are mounted on the disc and mechanically interconnected pivot on the disc radially outward as the disc speed increases. A pair of rollers are located in the space between the disc and the stationary surface, and, as the weights move radially outward, are progressively forced into the tapered area or gap, eventually contacting the stationary surface where they are wedged in the gap, abruptly stopping the rotation of the disc. The counterweights' center of masses and the pivot points are such that the centrifugal force of one weight is slightly greater than the other. An overspeed switch is operated by the weights at a certain speed.

3 Claims, 2 Drawing Figures

ELEVATOR GOVERNOR

TECHNICAL FIELD

This invention relates to elevator systems, specifically, the speed governors commonly used in elevator systems.

BACKGROUND ART

The typical elevator governor may consist of a disc that is driven by a governor rope secured to the car of the elevator, and may include at least one flyweight mounted on the disc. The flyweight responds to excessive speed by progressively moving outward under its own centrifugal force to push against a spring force, ultimately stopping the disc at a certain speed, which abruptly stops the rope. The rope is secured to an elevator safety actuated by the governor operation to bring the elevator car or the counterweight to a safe stop.

Most regulations on the construction of elevators specify that governors should also operate at a speed increase of about 20%–40% over maximum to deenergize the elevator drive motor. Typically this is done by operating a safety switch. This operation is in addition to the operation of the mechanical safety that typically slows the elevator car and/or counterweight by engaging a guide rail when the car or counterweight moves down.

One type has a rubber roller that is mounted on a lever, and rolls over a polygon-shaped disc so that the disc may be progressively stopped when the lever is lifted or moved as a function of the disc speed.

Another type of governor has a flywheel which operates a linkage that clamps the elevator governor rope. In this device the flywheels are forced against the inside surface of the governor housing, stopping the disc and applying force to the rope.

Among the disadvantages to these and other similar governors is that the response time, that is, the time required to engage the safety after the maximum speed condition has occurred, is relatively long and also variable. In most cases the reason is that the governor disc can only be stopped at discrete angular positions. This is particularly true of governors having polygon-shaped discs. They also suffer from knocking noise, as a result of the shape of the discs. This noise is evidence of the inherent discontinuous type of operation such governors provide. These and other governors respond only to speed increase of the governor rope above a predetermined value, not to excessively high accelerations (second derivative changes).

DISCLOSURE OF INVENTION

An object of the present invention is to provide a simple, inexpensive, highly reliable and quiet governor that responds both to excessive speed and acceleration.

According to the present invention, two flyweights are mounted on a flywheel or disc which rotates around a stationary surface. This disc is shaped, relative to the stationary surface, to define (preferably at diametrically opposite points) a narrow or tapered area—something like a wedge. The two flyweights that are mounted on this disc are mechanically interconnected, each being mounted so that it can pivot outwardly as the disc rotates. The two weights are mechanically connected and the outward motion of one imparts outward motion to the other. At least one stopping or braking roller is located between the disc and the stationary surface. As the weights move outwardly, this roller is progressively moved toward the stationary surface and progressively further into the tapered area between the stationary surface and the disc. At a certain position (a certain speed) it engages the stationary surface and, as a result, is rapidly pushed into the tapered surface, imparting stopping force to the disc when the disc is rotated opposite the direction of the taper (car down). A rope attached to the disc for the purpose of rotating it is abruptly stopped, thus applying a rapid force to the rope, which may be used to operate a safety device.

The two weights are configured relative to each other so that the centrifugal force of one about its pivot point on the disc is greater than the other, so that the governor not only responds to speed, but also to changes in speed (acceleration).

According to another aspect of the present invention, a microswitch may be located adjacent to the disc so as to be activated when the weights move out about their pivot points to a certain position. This microswitch may be used to deactivate the drive motor of some form, as in some prior art governor applications, when the car or counterweight is ascending.

A feature of the invention is that the safety is extremely simple and inexpensive, and requires no maintenance. An intriguing feature is that the disc can be abruptly stopped at any point in its angular rotation around the stationary surface—unlike prior art governors that can only stop at discrete positions. As a result, the tripping action of this governor is extremely precise and rapid, and subject to no variations as a result of the position of the disc when maximum speed is achieved. Another feature is that the governor also responds to acceleration, which results from the unbalance in the centrifugal force of the two weights. Prior art governors, on the other hand, typically respond only to speed conditions, not acceleration.

Other features, benefits, and attributes of the invention may be apparent from the following Brief Description of the Drawing and description of the Best Mode for Carrying Out the Invention.

BEST MODE FOR CARRYING OUT THE INVENTION

Figure 1:
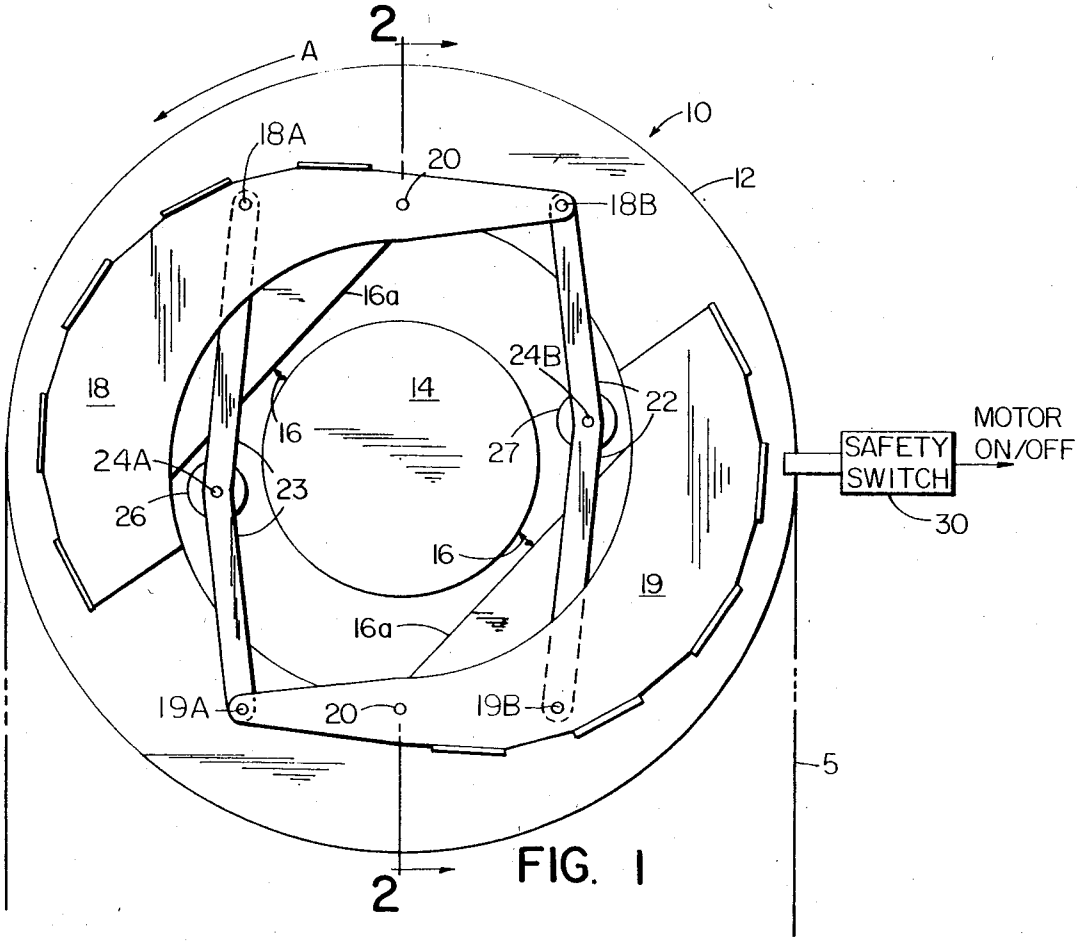
FIG. 1 is an elevational view of a governor embodying the present invention.

In the governor 10 shown in FIG. 1, a flywheel 12 or disc rotates around a circular stationary surface 14. This flywheel or disc is configured relative to the stationary surface so as to have at diametrically opposite points tapered areas or gaps 16, in this case, achieved by providing basically parallel surfaces **16*a* on diametrically opposite points around the stationary surface. (As developed later in this description, these tapered gaps provide a wedge braking surface which is used to rapidly decelerate the flyweight as it rotates in direction A.) The flywheel is connected to a rope 5** which may be connected to an elevator car or counterweight so that the flyweight is rotated as either the car or counterweight moves. (The car and counterweight are not shown.)

Figure 2:
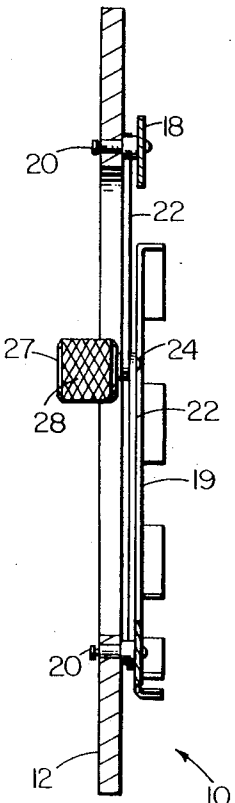
FIG. 2 is a sectional view, in the direction 2—2 in FIG. 1, showing primarily one of the flyweights.

The governor in FIG. 1 includes two flyweights 18, 19 which are generally located on diametrically opposite sides of the disc (FIG. 2 shows one weight, weight 19). Each of these weights pivots around its own pivot point 20 on the disc. The flyweights are connected by two linkages 22 and 23. Linkage 22 is connected at points 18B and 19B to the flyweights 18 and 19; linkage 23 is connected at points 18B, 19B. Points 18A and 18B are generally opposite each other relative to the flyweight pivot 20, and points 19A and 19B are related in the same fashion. As a result, when one counterweight pivots, it automatically imparts similar pivoting force to the other counterweight. At pivot point 24A, 24B on each rod there is a roller 26, 27 which contains a roughened or spline-like surface 28 (See FIG. 2). As the flyweights move outwardly, each rod pair is pushed progressively towards the center of rotation, and each roller is thereby pushed towards the center of rotation also. In addition, however, each roller is also moved in the clockwise direction (opposite direction A), due to the pivoting of the weights that occurs around their pivot points. When the flyweights move far enough outwardly, each roller will engage the circular stationary surface and be located at the tapered area or gap. When this occurs, the roller is jammed or wedged hard into the tapered area. This brings the disc to a very rapid stop, applying force to the rope. As in prior art safeties, this force may be used to operate a safety device of some sort that is connected to either the car or the counterweight, depending on the installation of the governor.

There is a special relationship between the two counterweights. Preferably, the mass of one counterweight is greater than the mass of the other, and thus the centrifugal force of one is greater than the other at a given speed. This creates two different levels of governor operation. At one level, the weights simply move outwardly as a result of the increase in centrifugal force with speed. At a "tripping speed" the governor operates. (To that extent, the mass of the two weights may be simply added together to compute the overall force applied to the rollers in forcing them into the tapered area, since they are mechanically connected together by the pairs of rods.) According to the second level, the rollers may be moved into position to engage the tapered area at a speed below tripping speed (below the speed at which the roller contacts the stationary speed) if there is sufficient acceleration or deceleration force applied. The reason is this: The two weights do not exert the same centrifugal force about their pivot point, because their masses are different. Because the centrifugal forces are therefore different, there is a small net mass, so to speak, which is responsive to acceleration changes.

One way to achieve this operation was mentioned: simply have one weight have a greater mass than the other. The same result could also be achieved, of course, by arranging the pivot point so that the centrifugal force around one pivot point is greater than the centrifugal force around the other pivot point. (The criteria is basically that the mass around the pivot point of one weight be somewhat greater than the mass around the other counterweight so that there is a centrifugal force unbalance at arc speeds.)

Though not specifically shown in the drawing (because it is well known in the art), a microswitch 30 may be located just along the outside of the rotating disc in a position to be engaged by the counterweights when they move outwardly when the car ascends (the disc rotates opposite direction A).

One skilled in the art may, of course, make various changes and alterations to the particular embodiment that has been shown and described without departing from the true scope and spirit of the invention embodied therein.

I claim:

1. An elevator governor characterized by:

a stationary surface;

a disc that is rotatable by a rope around the stationary surface, the disc having at least one surface opposite the stationary surface that defines a wedged or tapered space between the stationary surface and the disc;

a pair of weights that are pivotally mounted on the disc and mechanically interconnected so that the weights pivot simultaneously in the same radial direction; and a roller which is carried on the disc and located between the disc and the stationary surface and connected to the weights to be progressively moved into the tapered area as the weights pivot in a first direction in response to disc rotational speed, said roller mechanically connecting the disc and the stationary surface when the weights pivot to a first position.

2. The governor described in claim 1, characterized by:

the pivot points and masses of the weights being selected so that the rotational force of one weight about its pivot point is greater than the other as the disc rotates.

3. The governor described in claim 2, characterized by:

the weights being mechanically connected by two linkages;

each linkage having two sections connected at a pivot point located between the disc and the stationary surface;

one linkage being attached between a first position on one weight and a first position on the second weight, the second linkage being attached between a second position on one weight and a second position on the other weight, the first positions being approximately 180° from the second positions around each weight's pivot point; and the roller being attached at the pivot point between the sections of one of the linkages.

* * * * *